US010809654B2

(12) United States Patent
Taguchi et al.

(10) Patent No.: US 10,809,654 B2
(45) Date of Patent: Oct. 20, 2020

(54) PRESSURE ROLLER FOR FIXING APPARATUS, FIXING APPARATUS AND IMAGE FORMING APPARATUS

(71) Applicant: CANON KABUSHIKI KAISHA, Tokyo (JP)

(72) Inventors: Sho Taguchi, Fujisawa (JP); Naofumi Murata, Tokyo (JP); Katsuhisa Matsunaka, Inagi (JP); Yutaka Arai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/539,125

(22) Filed: Aug. 13, 2019

(65) Prior Publication Data

US 2020/0073295 A1 Mar. 5, 2020

(30) Foreign Application Priority Data

Aug. 28, 2018 (JP) ..... 2018-159770
Jul. 23, 2019 (JP) ..... 2019-135738

(51) Int. Cl.
*G03G 15/20* (2006.01)

(52) U.S. Cl.
CPC ..... *G03G 15/206* (2013.01); *G03G 15/2057* (2013.01); *G03G 15/2064* (2013.01)

(58) Field of Classification Search
CPC ..... G03G 15/2057; G03G 15/206
See application file for complete search history.

(56) References Cited

U.S. PATENT DOCUMENTS

| | | | |
|---|---|---|---|
| 7,974,563 | B2 | 7/2011 | Sakai et al. |
| 8,005,413 | B2 | 8/2011 | Sakakibara et al. |
| 8,224,223 | B2 | 7/2012 | Sakakibara et al. |
| 8,369,763 | B2 | 2/2013 | Sakakibara et al. |
| 8,401,450 | B2 | 3/2013 | Sekihara et al. |
| 8,626,046 | B2 | 1/2014 | Sekihara et al. |
| 9,086,664 | B2 | 7/2015 | Matsunaka et al. |
| 9,110,416 | B2 | 8/2015 | Uchiyama et al. |
| 9,152,110 | B2 | 10/2015 | Miura et al. |
| 9,268,273 | B2 | 2/2016 | Miyahara et al. |
| 9,304,461 | B2 | 4/2016 | Miura et al. |
| 9,348,282 | B2 | 5/2016 | Tamura et al. |

(Continued)

FOREIGN PATENT DOCUMENTS

| | | | |
|---|---|---|---|
| JP | 2002-351243 | A | 12/2002 |
| JP | 2012-027281 | A | 2/2012 |

(Continued)

*Primary Examiner* — Arlene Heredia
(74) *Attorney, Agent, or Firm* — Venable LLP

(57) ABSTRACT

A pressure roller, and the pressure roller to be used in a fixing apparatus of in an image forming apparatus, the fixing apparatus configured to heat a toner image formed on a recording material and fix the toner image on the recording material, the pressure roller including a first elastic layer, and a second elastic layer provided on an outside of the first elastic layer, wherein a thermal conductivity of the first elastic layer is higher than a thermal conductivity of the second elastic layer, and wherein the first elastic layer contains a plurality of void portions, hole pathway portions joining the plurality of void portions to each other, and a needle-shaped high thermal conductive filler.

19 Claims, 5 Drawing Sheets

(56) References Cited

U.S. PATENT DOCUMENTS

| | | | | |
|---|---|---|---|---|
| 9,348,283 | B2 | 5/2016 | Takada et al. | |
| 9,367,008 | B2 * | 6/2016 | Sakakibara ..... | G03G 15/2057 |
| 9,367,009 | B2 | 6/2016 | Akiyama et al. | |
| 9,465,338 | B2 | 10/2016 | Maeda et al. | |
| 10,281,858 | B2 | 5/2019 | Murata et al. | |
| 2012/0020709 | A1 * | 1/2012 | Uchiyama ..... | G03G 15/2057 399/333 |
| 2019/0033762 | A1 | 1/2019 | Ikegami et al. | |

FOREIGN PATENT DOCUMENTS

| | | | |
|---|---|---|---|
| JP | 2012-163812 | A | 8/2012 |
| JP | 2015-114367 | A | 6/2015 |

* cited by examiner

PRESSURE ROLLER FOR FIXING APPARATUS, FIXING APPARATUS AND IMAGE FORMING APPARATUS

BACKGROUND OF THE INVENTION

Field of the Invention

The present invention relates to a pressure roller for a fixing apparatus that is equipped in an image forming apparatus using one of an electrophotographic technique and an electrostatic recording technique, such as a copier, a printer (a laser printer, an LED printer and the like) and a facsimile apparatus, a fixing apparatus equipped with the pressure roller, and an image forming apparatus.

Description of the Related Art

In an image forming apparatus using an electrophotographic technique or the like, an image heating apparatus such as a fixing apparatus configured to heat a recording material supporting the toner image and fix the toner image on the recording material is used. For example, the fixing apparatus includes a heating member (fixing member) to contact with an unfixed toner on the recording material and a pressure roller to tightly contact with the heating member and form a nip portion (fixing nip). Then, the fixing apparatus supplies thermal energy to the recording material and the toner, at the fixing nip formed between the heating member and the pressure roller. Thereby, the toner on the recording material melts at the fixing nip. After passing through the fixing nip, the toner is cooled, solidified and fixed on the recording material.

As the fixing apparatus, a film heating type fixing apparatus having a good energy saving property and enabling quick start is known. The film heating type fixing apparatus includes a heating member adapted to include a cylindrical fixing film having flexibility and a heating element such as a ceramic heater, and a pressure roller to tightly contact with the heating member (more specifically, to tightly contact with the heating element across the fixing film). The fixing apparatus supplies the thermal energy from the heating element to the recording material and the toner through the fixing film, at the fixing nip where the pressure roller tightly contacts with the heating member.

For example, for the purpose of efficiently transferring the thermal energy from the heating member to the recording member and the toner in the above-described film heating type fixing apparatus, a fixing apparatus including the following pressure roller is known. That is, the pressure roller includes an elastic layer including a plurality of dispersed void portions and thereby having a low thermal conductivity. However, when the pressure roller having a low thermal conductivity is used, in the case where a recording material having a smaller width than the maximum usable width is used as the recording material, non-passing portion temperature rise easily occurs. Here, the "non-passing portion temperature rise" is a phenomenon of an excessive rise in the temperature of a region (also referred to as a "non-passing portion" herein) on the fixing apparatus through which the recording material does not pass, which is a region in a direction roughly orthogonal to a conveying direction of the recording material. The non-passing portion temperature rise becomes conspicuous at the time of a continuous passing in which there is no enough time for cooling.

Responding to this problem, a pressure roller provided with a plurality of elastic layers and separating functions to the elastic layers has been proposed, for achieving both a quick start property (the pressure roller is put into a fixation enabling state in a short time after the start of power-on) and a suppression of the non-passing portion temperature rise (Japanese Patent Application Laid-Open No. 2012-163812). That is, in this pressure roller, an outer-side elastic layer relatively close to a heat source is made of a foamed rubber or the like, and has a low thermal conductivity. On the other hand, an inner-side elastic layer relatively far from the heat source is a heat accumulating layer. When the thermal conductivity of the outer-side elastic layer in the thickness direction is $\lambda 1$ and the thermal conductivity of the inner-side elastic layer in the thickness direction is $\lambda 2$, there is a relation of $\lambda 1 < \lambda 2$. Thereby, the pressure roller has the quick start property because the surface of the pressure roller easily gets warm at the start of print, and can suppress the non-passing portion temperature rise by dissipating the excess heat at edge portions through the inner-side elastic layer (heat accumulating layer).

Meanwhile, in recent years, a fixing nip passing time (dwell time) that is a time before the recording material passes through the fixing nip tends to be shortened, in connection with demand of speed increase and size reduction of the fixing apparatus. As a result, the elastic layers constituting the pressure roller has been demanded to enable the securement of a sufficient fixing nip while maintaining a sufficient softness (responsiveness and trackability to the vibration at the time of compression and release) even at the time of a high-speed operation, and to enable the suppression of the above-described non-passing portion temperature rise.

In the pressure roller described in Japanese Patent Application Laid-Open No. 2012-163812, the heat accumulating layer is a non-porous layer, and contains a thermal conductive filler such as alumina and zinc oxide. The thermal conductive filler has an effect of enhancement of the thermal conductivity, but when the content ratio is high, the softness of the elastic layer is impaired. Hence, it is conceivable that a low hardness rubber is used as a base rubber and the thermal conductive filler is blended in the low hardness rubber. However, the low hardness rubber has a low strength, and therefore, the durability is sometimes insufficient. Further, it has been found that a necessary fixing nip cannot be sometimes secured in the non-porous heat accumulating layer at the time of a high-speed operation in which pressurization and release are performed at a high speed. This is because the deformation velocity of the rubber at the fixing nip is insufficient for the formation of the nip and therefore the rubber is not sufficiently transformed during the passing of the fixing nip.

SUMMARY OF THE INVENTION

Aspects of the embodiment of the present invention is a pressure roller for a fixing apparatus, a fixing apparatus and an image forming apparatus that enable the achievement of both the securement of a moderate softness of the elastic layer and the suppression of the non-passing portion temperature rise.

Another aspects of the embodiment of the present invention is a pressure roller to be used in a fixing apparatus, the fixing apparatus configured to heat a toner image formed on a recording material and fix the toner image on the recording material, the pressure roller including a first elastic layer, and a second elastic layer provided on an outside of the first elastic layer, wherein a thermal conductivity of the first elastic layer is higher than a thermal conductivity of the second elastic layer, and wherein the first elastic layer contains a plurality of void portions, hole pathway portions joining the plurality of void portions to each other, and a needle-shaped high thermal conductive filler.

A further aspect of the embodiment of the present invention is a fixing apparatus configured to heat a toner image formed on a recording material at a fixing nip portion while nipping and conveying the recording material and to fix the toner image on the recording material, the fixing apparatus including a heating unit, and a pressure roller to be used in a fixing apparatus, the fixing apparatus configured to heat a toner image formed on a recording material and fix the toner image on the recording material, the pressure roller including a first elastic layer, and a second elastic layer provided on an outside of the first elastic layer, wherein a thermal conductivity of the first elastic layer is higher than a thermal conductivity of the second elastic layer, and wherein the first elastic layer contains a plurality of void portions, hole pathway portions joining the plurality of void portions to each other, and a needle-shaped high thermal conductive filler.

A still further aspect of the embodiment of the present invention is an image forming apparatus configured to form a tonner image on a recording material, the image forming apparatus including an image forming unit configured to form the tonner image on the recording material, and a fixing apparatus configured to heat a toner image formed on a recording material at a fixing nip portion while nipping and conveying the recording material and to fix the toner image on the recording material, the fixing apparatus including a heating unit, and a pressure roller to be used in a fixing apparatus, the fixing apparatus configured to heat a toner image formed on a recording material and fix the toner image on the recording material, the pressure roller including a first elastic layer, and a second elastic layer provided on an outside of the first elastic layer, wherein a thermal conductivity of the first elastic layer is higher than a thermal conductivity of the second elastic layer, and wherein the first elastic layer contains a plurality of void portions, hole pathway portions joining the plurality of void portions to each other, and a needle-shaped high thermal conductive filler.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

1. Image Forming Apparatus

Figure 1:
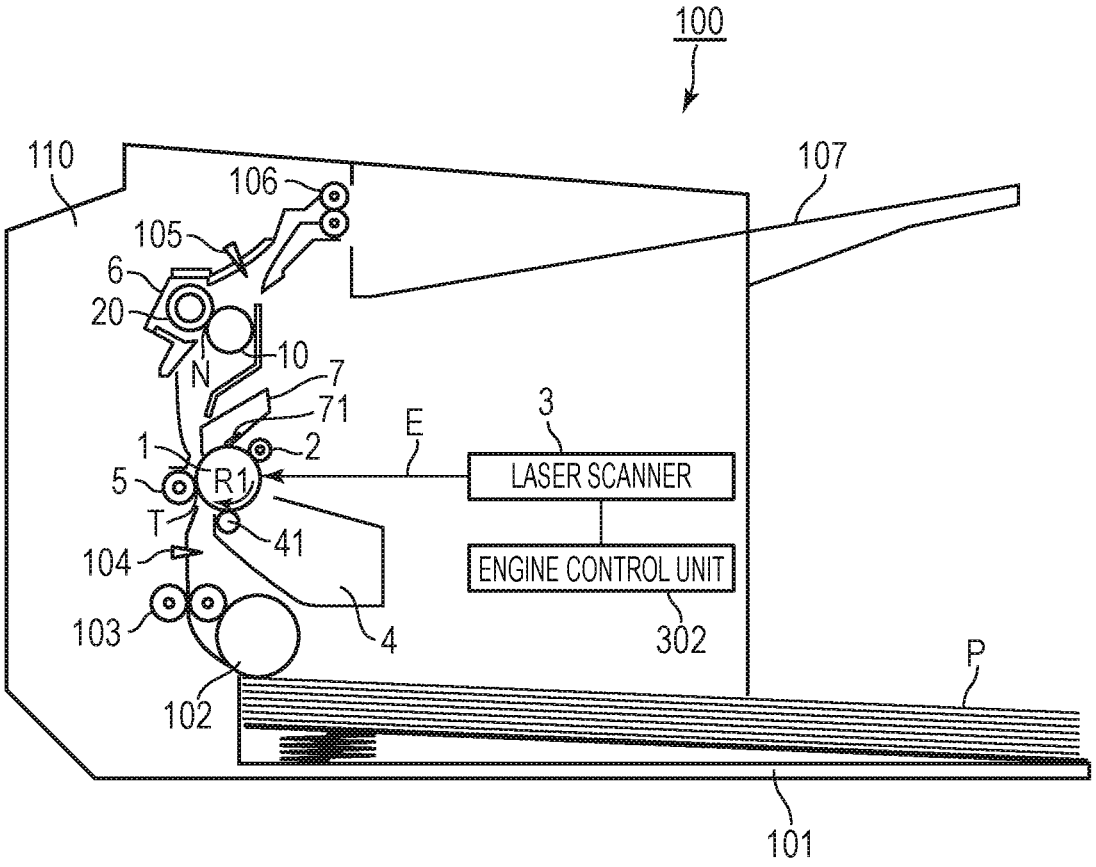
FIG. 1 is a schematic sectional view of an image forming apparatus.

FIG. 1 is a schematic sectional view of an image forming apparatus 100 in the embodiment. The image forming apparatus 100 in the embodiment is a laser printer using an electrophotographic technique. Herein, a direction roughly orthogonal to a conveying direction of a later-described recording material P is also referred to as a "longitudinal direction". The longitudinal direction is roughly parallel to a rotation axis direction of a later-described photosensitive drum 1 and a pressure roller 20 of a later-described fixing apparatus 6.

The image forming apparatus 100 includes a photosensitive drum 1 that is a drum-shaped (cylindrical) rotatable photoreceptor (electrophotographic photoreceptor) as an image supporting body configured to support a toner image. The photosensitive drum is adapted by providing a photosensitive material such as an organic photosemiconductor (OPC), amorphous selenium and amorphous silicon, on a cylinder-shaped drum base body formed of an aluminum alloy, nickel and the like. The photosensitive drum 1 is driven and rotated at predetermined processing speed (circumferential velocity) in the direction of an arrow R1 in the figure, by a drive motor (not illustrated) as a drive unit. The surface of the photosensitive drum 1 is evenly charged at a predetermined electric potential with a predetermined polarity (the negative polarity in the embodiment), by a charging roller 2 that is a roller-shaped charging member as a charging unit. The charging roller 2 is disposed so as to abut on the surface of the photosensitive drum 1. The charged surface of the photosensitive drum 1 is scanned and exposed by an exposure apparatus (laser scanner) 3 as an exposure unit, so that an electrostatic image (electrostatic latent image) is formed on the photosensitive drum 1. The laser scanner 3 forms the electrostatic image, by emitting a laser beam E, for which an ON/OFF control is performed depending on image information, to the surface of the photosensitive drum 1 and removing the electric charge on the exposure portion. The electrostatic image formed on the photosensitive drum 1 is developed (visualized) by the supply of a toner as a developer from a development apparatus 4 as a develop unit, so that a toner image (developer image) is formed on the photosensitive drum 1. The development apparatus 4 includes a development roller 41 as a developer supporting body configured to support the toner and convey the toner to a portion (development portion) facing the photosensitive drum 1. As the development method, a jumping development method, a two-component development method or the like is used. In the embodiment, the toner charged with the same polarity (the negative polarity in the embodiment) as the charged polarity of the photosensitive drum 1 adheres to an exposure portion (image portion) on the photosensitive drum 1 in which the absolute value of the electric potential is decreased due to the exposure depending on the image information after the uniform charging process (reversal development).

A transfer roller 5 that is a roller-shaped transfer member as a transfer unit is disposed so as to face the photosensitive drum 1. The transfer roller 5 is biased toward the photosensitive drum 1, and forms a transfer portion (transfer nip) T where the transfer roller 5 abuts on the photosensitive drum 1. At the transfer T, the toner image formed on the photosensitive drum 1 as described above is transferred on the recording material (transfer material, sheet) P sandwiched between and conveyed by the photosensitive drum 1 and the transfer roller 5. At the time of the transfer, a transfer voltage (transfer bias) with the reverse polarity (the positive polarity in the embodiment) of the proper charged polarity (the charged polarity at the time of the development) of the toner is applied to the transfer roller 5. The recording material P is stored in a recording material tray 101, is fed by a feeding roller 102 one by one, and is supplied to the transfer portion T at a predetermined timing by a conveying roller 103 and the like. On this occasion, the leading end of the recording material P is detected by a top sensor 104, and the timing when the leading end of the recording material P arrives at the transfer portion T is detected from the positional relation between the top sensor 104 and the transfer portion T and the conveying velocity of the recording material P.

The recording material P with the transferred tonner image is conveyed to the fixing apparatus 6 as an image heating apparatus. The fixing apparatus 6 heats and pressurizes the recording material supporting the unfixed toner image (image), and fixes (melts and anchors) the tonner image on the surface of the recording material P. The fixing apparatus 6 will be described later in further detail. The recording material P with the fixed toner image is ejected (output) on an ejection tray 107 formed in the exterior (upper surface) of an apparatus body 110 of the image forming apparatus 100, by an ejection roller 106. During the ejection, an ejection sensor 105 detects timings when the leading end and tail end of the recording material P pass, and monitors whether a jam or the like occurs.

On the other hand, the toner (transfer remaining tonner) remaining on the surface of the photosensitive drum 1 without being transferred to the recording material P at the time of the transfer is removed and collected from the photosensitive drum 1, by a cleaning apparatus 7 as a cleaning unit. The cleaning apparatus 7 sweeps and removes the transfer remaining toner from the surface of the rotating photosensitive drum 1, with a cleaning blade 71 as a cleaning member disposed so as to abut on the surface of the photosensitive drum 1.

In the embodiment, the photosensitive drum 1, the charging roller 2, the exposure apparatus 3, the development apparatus 4, the transfer roller 5 and the like constitute an image forming unit configured to form an image on the recording material P.

2. Whole Configuration of Fixing Apparatus

Figure 2A:
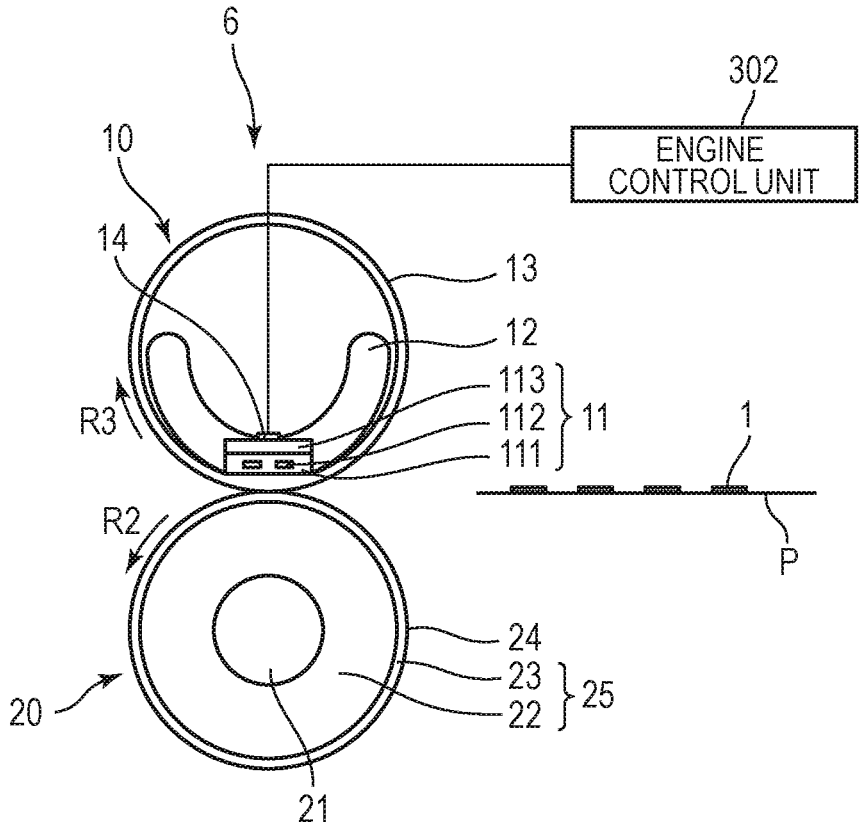
FIG. 2A illustrates a schematic sectional view of a fixing apparatus.

FIG. 2A is a schematic sectional view of the fixing apparatus 6 as the image heating apparatus in the embodiment (a section roughly orthogonal to the rotation axis direction of the later-described pressure roller 20).

The fixing apparatus 6 in the embodiment is a film heating type fixing apparatus. The fixing apparatus 6 includes a heating member 10 and the pressure roller 20 to tightly contact with the heating member 10. The fixing member (heating unit) 10 is adapted to include a fixing film 13, a heater 11 and a holder (heat-insulating stay holder) 12. The fixing film 13 is an exemplary heating rotation body as a heat-transfer member constituted by a cylindrical heat-resisting film having flexibility. The heater 11 is an exemplary heating element (thermal source, heat source, heat element). The holder 12 is an exemplary holding member configured to hold the heater 11. The heater 11 is disposed so as to be fixed to the holder 12. The holder 12 functions also as a guide configured to restrict the rotation locus of the fixing film 13. The pressure roller 20 is disposed so as to face the heater 11 across the fixing film 13.

In the embodiment, the holder 12 to which the heater 11 is fixed is biased toward the pressure roller 20. Thereby, a fixing nip N where the pressure roller 20 tightly contacts with the heater 11 and the holder 12 across the fixing film 13 is formed. Further, in the embodiment, the pressure roller 20 is driven and rotated in the direction of an arrow R2 in the figure, by a drive motor (not illustrated) as a drive unit. Thereby, in the embodiment, the fixing film 13 is rotated (revolved) in the direction of an arrow R3 in the figure by the pressure roller 20, while being sandwiched between the pressure roller 20, and the heater 11 and the holder 12. At the fixing nip N, the fixing apparatus 6 nips and conveys the recording material P supporting the unfixed toner image t, together with the fixing film 13. Thereby, thermal energy is supplied from the heating member 10 to the recording material P and the tonner image t, and the tonner image t is fixed (molted and anchored) on the recording material P.

A thermistor 14 that is a temperature detecting element as a temperature detecting unit is disposed so as to abut on a surface of the heater 11 that is opposite to a surface to slide on the fixing film 13. A signal indicating a detection result of the thermistor 14 is input to an engine control unit 302. Based on this signal, the engine control unit 302 controls the electric current to be supplied to the heater 11, such that the temperature of the heater 11 is a desired temperature.

The heater 11 includes a resistance heating layer 112 on a substrate (insulating substrate) 113 formed of a ceramic (alumina, aluminum nitride or the like). Further, the resistance heating layer 112 is covered with an overcoat glass 111 for electric insulation and abrasion resistance. The heater 11 is adapted such that the overcoat glass 111 contacts with the inner circumferential surface of the fixing film 13.

3. Fixing Film

In the embodiment, the fixing film 13 is a composite layer film including a base layer formed of a thin metallic element tube such as stainless steel (SUS) and a heat-resisting resin film such as polyimide and PEEK, and a releasable layer formed on the base layer. The releasable layer can be formed by coating the surface of the base layer with a material such as PFA, PTFE and FEP directly or across a primer layer, or by covering the surface of the base layer with a tube formed of the same material. Particularly, the embodiment uses the fixing film 13 adapted by forming the releasable layer by coating the base layer formed of polyimide with PFA. In the embodiment, the whole thickness (total film thickness) of the fixing film 13 is 70 μm, and the outer circumferential length of the fixing film 13 is 56.7 mm.

Since the fixing film 13 rotates while sliding so as to contact with the heater 11 and the holder 12 disposed on the inner circumferential surface side, it is desirable to reduce the friction resistance of the fixing film 13 against the heater 11 and the holder 12. Therefore, an appropriate amount of lubricant such as a heat-resisting grease is interposed between the surfaces of the heater 11 and the holder 12 and the inner circumferential surface of the fixing film 13. Thereby, the fixing film 13 can smoothly rotate.

4. Pressure Roller

<Whole Configuration of Pressure Roller>

Figure 2B:
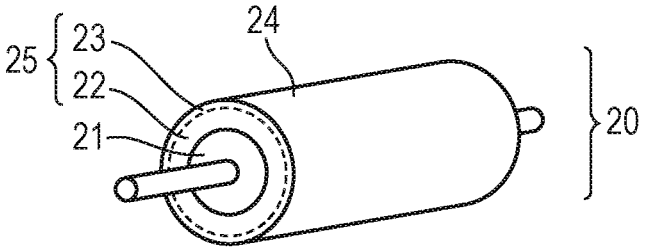
FIG. 2B illustrates a schematic perspective view of a pressure roller.

FIG. 2B is a schematic perspective view of the pressure roller 20 in the embodiment. The pressure roller 20 has a multi-layer configuration in which an inner elastic layer (first elastic layer) 22, an outer elastic layer (second elastic layer) 23, and a surface release layer 24 are laminated on a core bar (base material) 21 in order.

The core bar 21 is adapted to include a rigid body portion at a central portion in the longitudinal direction and a shaft portion provided at both end portions in the longitudinal direction and having a smaller diameter than the body portion. The inner elastic layer 22 and the outer elastic layer 23 constitute an elastic layer 25. The inner elastic layer 22, the outer elastic layer 23 and the surface release layer 24 are provided on the outer circumference of the body portion of the core bar 21. The inner elastic layer 22 and the outer elastic layer 23 are made using a heat-resisting rubber. The surface release layer 24 is made using a fluorine resin. In the embodiment, the outer diameter of the pressure roller 20 is 20 mm, and the thickness of the elastic layer 25 (the total thickness of the inner elastic layer 22 and the outer elastic layer 23) is 2.5 mm. Further, in the embodiment, the length (total length) in the longitudinal direction of the pressure roller 20 is 289 mm (the length in the longitudinal direction of the body portion of the core bar 21, the inner elastic layer 22, the outer elastic layer 23 and the surface release layer 24 is about 250 mm).

As described later in further detail, in the embodiment, the inner elastic layer 22 is made using a heat-resisting silicone rubber, and includes void portions, hole pathway portions joining void portions and void portions, and a needle-shaped filler (high thermal conductive filler). Further, in the embodiment, the outer elastic layer 23 is made using a heat-resisting silicone rubber, and includes void portions.

<Core Bar>

As the core bar of the pressure roller for the fixing apparatus, a solid core bar and a hollow pipe-shaped core bar are known. In the case of the hollow pipe-shaped core bar, a heating element is sometimes disposed in the interior.

In the embodiment, as the core bar 21, both the solid core bar and the hollow pipe-shaped core bar can be used. However, the heating element does not need to be disposed in the interior of the core bar 21. The purpose is to obtain a configuration of promoting heat release from the inner elastic layer 22 through the core bar 21, for suppressing the non-passing portion temperature rise.

The core bar 21 can be made of a metal material such as aluminum, an aluminum alloy, steel and a stainless alloy. Further, the shape and the like can be selected such that the core bar 21 has a strength enabling a desired nip shape to be formed by giving a load necessary for the formation of the fixing nip N.

In the embodiment, the core bar 21 is a solid steel core bar, and is adapted to include the body portion at the central portion in the longitudinal direction and the shaft portion provided at both end portions in the longitudinal direction and having a smaller diameter than the body portion. In the embodiment, the outer diameter of the body portion of the core bar 21 is 15 mm. Further, in the embodiment, the length (total length) in the longitudinal direction of the core bar 21 is 289 mm (the length in the longitudinal direction of the body portion of the core bar 21 is about 250 mm).

<Inner Elastic Layer (First Elastic layer)>

Figure 3A:
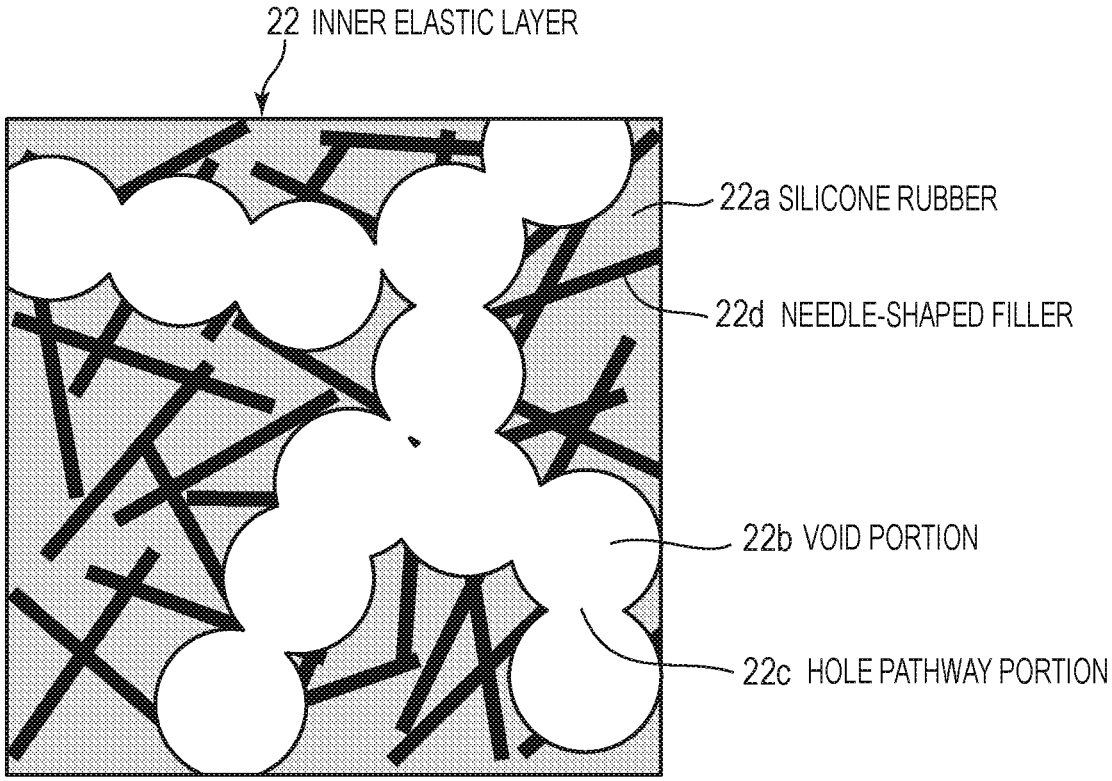
FIG. 3A is a schematic sectional view of an inner elastic layer of the pressure roller.

FIG. 3A is a schematic sectional view showing a minute structure of the inner elastic layer 22. The main component of the inner elastic layer 22 is a heat-resisting silicone rubber 22*a*. In the silicone rubber 22*a*, the inner elastic layer 22 includes a plurality of dispersed void portions 22*b*, hole pathway portions 22*c* joining void portions 22*b* and void portions 22*b*, and dispersed needle-shaped fillers 22*b*. That is, the void portion 22*b* of the inner elastic layer 22 has a structure (communication hole) in which adjacent void portions 22*b* of the plurality of void portions 22*b* are connected with each other by the hole pathway portion 22*c*. In the embodiment, a silane coupling agent, an adhesive agent and the like are blended in the silicone rubber 22*a* of the inner elastic layer 22, and the inner elastic layer 22 is integrated with the core bar 21 by the adhesive agent and the like. The inner elastic layer 22 will be described later in further detail.

<Outer Elastic Layer (Second Elastic Layer)>

Figure 3B:
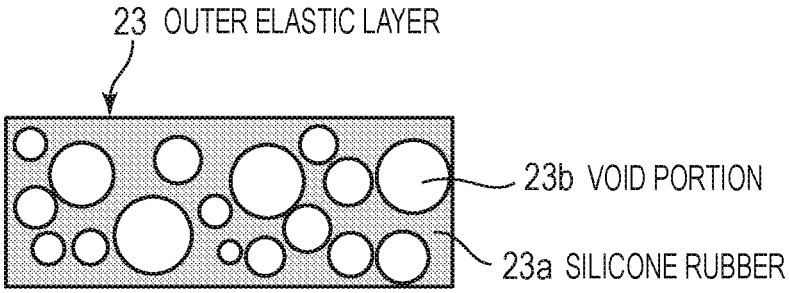
FIG. 3B is a schematic sectional view of an outer elastic layer of the pressure roller.

FIG. 3B is a schematic sectional view showing a minute structure of the outer elastic layer 23. The main component of the outer elastic layer 23 is a heat-resisting silicone rubber 23*a*. In the silicone rubber 23*a* of the outer elastic layer 23, an adhesive component can be blended, for the integration with the surface release layer 24 and the silicone rubber 22*a* of the inner elastic layer 22. Specifically, a silane coupling agent can be blended for the integration with the surface release layer 24. Further, a silicone rubber ingredient (an ingredient having a functional group such as an Si-vinyl group and an Si-hydroxyl group) to be involved in a hydrosilylation reaction can be blended for the integration with the inner elastic layer 22. In this way, the outer elastic layer 23, the surface release layer 24 and the inner elastic layer 22 can be integrated.

The outer elastic layer 23 can include a plurality of dispersed void portions 23*b*, in the silicone rubber 23*a*. The outer elastic layer 23 abuts on the heating member 10 across the surface release layer 24, until the recording material P is conveyed to the fixing nip N. By providing the void portions 23*b* in the outer elastic layer 23, the heat penetration in the outer elastic layer 23 from the surface release layer 24 side to the inner elastic layer 22 side can be prevented, and the thermal energy from the heating member 10 can be transferred to the recording material P without waste. Here, similarly to the void portion 22*b* of the inner elastic layer 22, the void portion 23*b* of the outer elastic layer 23 may have a structure (communication hole) in which void portions 23*b* are connected with each other by the hole pathway portion. However, the void portion 23*b* of the outer elastic layer 23 may have a structure (independent hole) in which void portions 23*b* are not connected with each other by the hole pathway portion. This is because the thickness of the outer elastic layer 23 is relatively small and therefore the influence on the change in the outer diameter of the pressure roller 20 due to the expansion and contraction of the air existing in the interior of the void portion 23*b* at the time of heating and cooling is small even in the case of the independent hole. The outer elastic layer 23 may contain both the communication hole and the independent hole. The thermal conductivity of the inner elastic layer 22 is higher than the thermal conductivity of the outer elastic layer 23.

The thickness of the outer elastic layer 23 is decided in consideration of the quick start property and non-passing portion temperature rise property of the fixing apparatus 6. It is necessary to prevent the heat penetration from the heating member 10 in a relatively short time scale of several seconds (the time of heating start), and to transfer heat to the inner elastic layer 22 in a relatively long time scale of several minutes (the time of continuous passing and the like). The thickness of the outer elastic layer 23 preferably should be 150 μm or larger and smaller than 500 μm, and more preferably should be 200 μm or larger and smaller than 400 μm. When the thickness of the outer elastic layer 23 is smaller than 150 μm, heat is transferred even in a short time scale, and it is difficult to exert a sufficient quick start property. When the thickness of the outer elastic layer 23 is 500 μm or larger, it takes too much time to transfer heat to the inner elastic layer 22, and thereby, heat accumulates, so that it is difficult to sufficiently suppress the non-passing portion temperature rise.

The outer elastic layer 23 can be formed of a known porous material. As the porous material, for example, materials described below can be applied. First, there is a material that becomes porous using a thermally degradable organic blowing agent concurrently with the cross-linkage of rubber components by heating. Further, there is a material that becomes porous using an emulsion resulting from mixing a non-cross-linkage material of the liquid silicone rubber and water with a thickener, an emulsifier and others. Further, there is a material that becomes porous using a hollow particle (hollow filler) dispersed in a silicone rubber material. As the outer elastic layer 23, the embodiment uses a porous material in which the void portions 23*b* is formed using the same resin microballoon (hollow particle) as a resin microballoon in the case of the void portion 22*b* of the inner elastic layer 22 described later in detail. As the silicone rubber 23*a* of the outer elastic layer 23, the same silicone rubber as the silicone rubber 22*a* of the inner elastic layer 22 described later in detail can be used.

<Surface Release Layer>

The main component of the surface release layer 24 is a fluorine resin. As the fluorine resin, for example, a fluorine-type resin selected from the group consisting of tetrafluoroethylene-perfluoro alkyl vinyl ether copolymer (PFA), tetrafluoroethylene-hexafluoropropylene copolymer (FEP) and polytetrafluoroethylene (PTFE), a mixture of the polymers, or a material resulting from dispersing the polymers in a heat-resisting resin or a rubber can be applied. As the surface release layer 24, the embodiment uses a resin tube (fluorine resin tube) formed of the resins.

Figure 4:
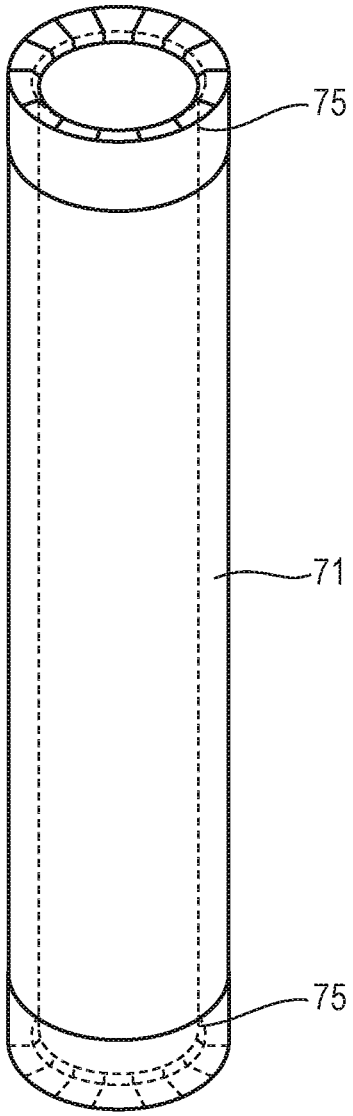
FIG. 4 is a schematic perspective view of a forming mold for the pressure roller.

Examples of the forming method for the surface release layer 24 made of the resin tube include methods described below. There are a method of fixing the resin tube to the outer circumference of the elastic layer 25 with an adhesive agent after forming the elastic layer 25, a method of disposing the resin tube in the interior of a cylindrical outer die and causing the resin tube to adhere concurrently with the formation of the elastic layer 25. The embodiment uses a method of disposing the resin tube in the interior of a cylindrical outer die as shown in FIG. 4, fixing the resin tube to opening portions at both ends in the longitudinal direction of the outer die, and integrating the resin tube (the surface release layer 24) and the outer elastic layer 23. FIG. 4 illustrates a state where the resin tube disposed in the interior of the cylindrical outer die is folded and fixed at both opening end portions. The production method of the pressure roller 20 will be described later in further detail.

The thickness of the surface release layer 24 is 100 μm or smaller, and preferably should be 10 μm or larger and 50 μm or larger. When the thickness of the surface release layer 24 is too large, the hardness of the pressure roller 20 increases, and it is sometimes difficult to stably form the fixing nip N. In the embodiment, the thickness of the surface release layer 24 is 30 μm. In the embodiment (later-described experiment examples and the like), for simplification, the thickness of the inner elastic layer 22 or the total thickness of the inner elastic layer 22 and the outer elastic layer 23 is sometimes shown, without regard for the thickness of the surface release layer 24.

5. Detail of Inner Elastic Layer

Next, the configuration of the inner elastic layer 22 will be described in more detail. According to the embodiment, the inner elastic layer 22 has a minute structure described below, and thereby, the embodiment can give a desired dynamic viscoelastic property and thermal conductivity property to the pressure roller 20. That is, for achieving both the quick start property and the suppression of the non-passing portion temperature rise at the time of a high-speed operation, the following configuration is desired. The configuration is a configuration of exerting the softness (responsiveness and trackability to the vibration at the time of compression and release) of the pressure roller even at the time of a high-speed operation, similarly to a low-speed operation, and enabling a stable securement of the fixing nip N both at the time of the low-speed operation and at the time of the high-speed operation. The embodiment can provide the pressure roller 20 that exerts the softness even at the time of the high-speed operation, similarly to the low-speed operation, and can achieve both the quick start property and the suppression of the non-passing portion temperature rise.

<Silicone Rubber>

The silicone rubber 22*a* can be a silicone rubber formed of a silicone rubber material that is cured by heating and has rubber-like elasticity, but the kind and the like are not particularly limited. Examples of the silicone rubber material include (1) an addition reaction curing type liquid silicone rubber composition that contains alkenyl group-containing diorgano polysiloxane, silicon atom bonded hydrogen atom-containing organohydrogen polysiloxane and a reinforcement filler and that becomes a silicone rubber by being cured by a platinum-based on catalyst, (2) an organic peroxide curing type silicone rubber composition that contains alkenyl group-containing diorgano polysiloxane and a reinforcement filler and that becomes a silicone rubber by being cured by an organic peroxide, and (3) a condensation reaction curing type liquid silicone rubber composition that contains hydroxyl group-containing diorgano polysiloxane, silicon atom bonded hydrogen atom-containing organohydrogen polysiloxane and a reinforcement filler and that becomes a silicone rubber by being cured by a condensation reaction accelerator catalyst such as an organic tin compound, organic titanium compound and a platinum-based catalyst.

Among these compositions, the silicone rubber material can be the addition reaction curing type liquid silicone rubber composition, in terms of processing formability. For example, when the viscosity of a liquid material containing, as the main component, diorgano polysiloxane that is a starting material is 0.1 Pa·S or higher at 25° C., a rubber-like formed product can be easily obtained using a known processing method such as a mold casting method. As the liquid silicone rubber, a commercially available liquid silicone rubber can be employed, and as necessary, a thickener, a toughening agent and the like can be added in addition to later-described blending materials.

<Void Portion>

By providing the void portions 22*b* in the inner elastic layer 22, both the quick start property and the suppression of the non-passing portion temperature rise at the time of the high-speed operation can be achieved.

When the compression and release of the pressure roller 20 are repeated at the fixing nip N, the compression and release of the elastic layer 25 (the inner elastic layer 22 and the outer elastic layer 23) are also repeated. According to the study by the inventors, in the case where the inner elastic layer 22 was a non-porous layer in which the void portions 22*b* were not provided, a necessary fixing nip N could not be secured at the time of a high-speed operation in which the pressurization and release were performed at a high speed (see later-described experiment examples). This is thought to be based on the following cause, as a result of the evaluation of the frequency dependence property of the dynamic viscoelasticity of the inner elastic layer 22. That is, in the non-porous inner elastic layer 22, in the case where the repetition period of the pressurization and the release is small (short), the deformation becomes insufficient because of lack of the softness (responsiveness and trackability to the vibration at the time of compression and release) of the inner elastic layer 22. Herein, it is assumed that the high-speed operation is an operation in which the processing velocity (corresponding to the conveying velocity of the recording material P at the fixing nip N) is 250 mm/sec or higher, for example, about 270 mm/sec. Further, herein, it is assumed that the low-speed operation is an operation in which the processing velocity (corresponding to the conveying velocity of the recording material P at the fixing nip N) is lower than 200 mm/sec, for example, about 180 mm/sec.

Specifically, as the dynamic viscoelastic property of the inner elastic layer 22, a rate E*(50 Hz)/E*(1 Hz) of the complex elastic modulus described below was evaluated by a method described later in detail. That is, the rate between a complex elastic modulus E*(1 Hz) when the frequency of the stress is a low frequency of 1 Hz and a complex elastic modulus E*(50 Hz) when the frequency of the stress is a high frequency of 50 Hz, namely, E*(50 Hz)/E*(1 Hz) was evaluated. As a result, for the dynamic viscoelastic property of the non-porous elastic layer, E*(50 Hz)/E*(1 Hz) was about 1.5, and it was found that the frequency dependence was relatively high.

On the other hand, for the dynamic viscoelastic property of the porous inner elastic layer 22 in which the void portions 22*b* according to the embodiment were provided, E*(50 Hz)/E*(1 Hz) was 1.3 or lower, typically, 1.1 or lower, and the frequency dependence was hardly recognized. That is, it was confirmed that the fixing nip N could be stably secured even when the pressurization and release were repeated at a low speed or even when the pressurization and release were repeated at a high speed.

Here, most of the void portions 22*b* of the inner elastic layer 22 are so-called communication holes communicating with the "exterior" through hole pathway portions 22*c*. The "exterior" means the periphery of the pressure roller 20. In the embodiment, although the outer circumference of the elastic layer 25 (the inner elastic layer 22 and the outer elastic layer 23) is covered with the surface release layer 24, lateral surfaces (end surfaces) of the inner elastic layer 22, at both end portions in the longitudinal direction of the pressure roller 20, are exposed to the periphery of the pressure roller 20, and are in a state of communicating with the "exterior". A porous elastic body having a communication hole structure facilitates the inflow and outflow of the air existing in the interior of the void portion, compared to a porous elastic body having no communication hole structure (that is, having an independent hole structure). For example, in the case where the pressure roller 20 is heated, the air thermally expands in the interior of the void portion 22*b* of the inner elastic layer 22, and is discharged to the exterior through the hole pathway portion 22*c*, resulting in the suppression of the change in the outer diameter of the pressure roller 20.

Examples of the method for forming the void portion 22*b* having such a communication hole structure include methods described below. Examples of the method include a method of using a thermally degradable organic blowing agent concurrently with the cross-linkage of rubber components by heating and a method of using an emulsion resulting from mixing a non-cross-linkage material of the liquid silicone rubber and water with a thickener, an emulsifier and others. As the method for forming the void portion 22*b* of the inner elastic layer 22, the embodiment can use a resin microballoon that is a hollow particle dispersed in the liquid silicone rubber. In this case, by adding a resin microballoon flocculant having a high affinity with the resin microballoon and having a low affinity with the silicone rubber material, the hole pathway portion 22*c* can be formed concurrently with the heat forming.

As the resin microballoon, various kinds are available. In the embodiment, an expanded resin microballoon (trade name: F80-DE manufactured by Matsumoto Yushi-Seiyaku Co., Ltd.) having an average particle diameter of 10 to 200 μm and having an acrylonitrile shell is used, in consideration of the dispersibility in the liquid silicone rubber, the dimension stability at the time of forming and the ease of handling. The blending quantity of the resin microballoon in the liquid silicone rubber can be appropriately selected in consideration of the specific weight of the formed body. In 100 pts.wt. of the liquid silicone rubber, the blending quantity of the resin microballoon is ordinarily 0.5-8 pts.wt., and preferably should be 2-5 pts.wt. When the blending quantity of the resin microballoon is less than 2 pts.wt., the specific weight of the formed body becomes high and the formed body becomes hard, in some cases. Moreover, the formation of the hole pathway portion 22*c* by the addition of the flocculant sometimes becomes unstable. Further, when the blending quantity of the resin microballoon is more than 5 pts.wt., the volume of the resin microballoon becomes large, and a special attention to the blending of the liquid silicone rubber is sometimes needed.

As the flocculant, in the embodiment, tetraethylene glycol is used. The addition quantity of the flocculant in the liquid silicone rubber, which depends on the blending quantity of the resin microballoon in the liquid silicone rubber, is approximately 3-15 pts.wt. in 100 pts.wt. of the liquid silicone rubber. When the addition quantity of the flocculant is less than 3 pts.wt., many isolate void portions 22*b* that do not communicate are sometimes generated. Further, when the addition quantity of the flocculant is more than 15 pts.wt., the heating moldability sometimes becomes low.

The volume ratio of the communicating void portions 22*b* (communication holes) is 35 vol % or more and 65 vol % or less of the whole volume of the inner elastic layer 22. When the volume ratio of the void portions 22*b* is less than 35 vol %, the durability of the rubber sometimes becomes low, and when the volume ratio of the void portions 22*b* is 65 vol % or more, the rubber sometimes becomes too hard to form the fixing nip N. The present invention is not limited to a configuration in which all void portions 22*b* of the inner elastic layer 22 are communication holes, and the inner elastic layer 22 may contain independent holes.

<Needle-Shaped Filler>

The needle-shaped filler 22*d* is dispersed in the silicone rubber 22*a*, almost at random. As described later in detail, the inner elastic layer 22 is formed by pouring a liquid material containing the needle-shaped filler in a mold and causing the liquid material to flow. On this occasion, the needle-shaped filler 22*d* having a high aspect ratio is generally oriented along the flow. In the case where the hollow particle (hollow filler) is used as the material for forming the void portion 22*b*, the orientation of the needle-shaped filler 22*d* in the flowing direction can be suppressed. The reason is thought to be that the hollow particle acts as a so-called disturbance particle. Therefore, in the case where the hollow particle for forming the void portion 22*b* exists, relatively more joining paths, which enable the exertion of the specific property of the needle-shaped filler and are based on the contact between needle-shaped fillers, are formed in the thickness direction of the inner elastic layer 22, compared to the case where the hollow particle does not exist.

Examples of the needle-shaped filler 22*d* include a pitch-based carbon fiber, a PAN-based carbon fiber, a glass fiber and an inorganic whisker. For example, in the case where a carbon fiber having a high thermal conductivity is used as the needle-shaped filler, the above-described joining path functions as a thermal conduction path, and the heat conductivity in the thickness direction of the inner elastic layer 22 is enhanced compared to the case where the hollow particle does not exist. Since the inner elastic layer 22 is laminated on the metallic core bar 21 as described above, the heat accumulated in the non-passing portion of the pressure roller 20 can be effectively released to the core bar 21 through the above thermal conduction path. Herein, the needle-shaped filler (or fiber-shaped filler) means a filler having a needle shape (or fiber shape) that is long in one direction. More specifically, without being limited to this filler, a needle-shaped filler (or fiber-shaped filler) having an aspect ratio (length/diameter) of 10 or higher, preferably, 20 or higher can be suitably used.

The thermal conductivity $\lambda$ of the pressure roller 20 can be measured by a later-described method. The thermal conductivity $\lambda$ of the pressure roller 20 depends on the blending quantities of the resin microballoon and the needle-shaped filler to be blended in the silicone rubber that is the main component of the elastic layer 25, and can be higher than 0.5 [W/m·K] and 3.0 [W/m·K] or lower. When the thermal conductivity $\lambda$ of the pressure roller 20 is 0.5 [W/m·K] or lower, it is sometimes difficult to suppress the non-passing portion temperature rise. Further, when the thermal conductivity $\lambda$ of the pressure roller 20 is higher than 3.0 [W/m·K], a large quantity of needle-shaped filler is needed, and the forming is sometimes difficult.

As described above, the thermal conductivity $\lambda 2$ of the inner elastic layer 22 is higher than the thermal conductivity $\lambda 1$ of the outer elastic layer 23. The thermal conductivity $\lambda 2$ of the inner elastic layer 22 can be 0.2 [W/m·K] or higher and 1.0 [W/m·K] or lower, and the thermal conductivity $\lambda 1$ of the outer elastic layer 23 can be 0.05 [W/m·K] or higher and 0.2 [W/m·K] or lower. The measurement method for the thermal conductivities $\lambda 1$, $\lambda 2$ will be also described later.

In the embodiment, as the needle-shaped filler 22*d*, a pitch-based carbon fiber (trade name: GRANOC Milled Fiber XN-100-25M (manufactured by Nippon Graphite Fiber Corporation), fiber diameter 9 μm, average fiber length 250 μm, aspect ratio 28, density 2.2 g/cm$^3$) exhibiting a high thermal conductivity is used.

6. Production Method for Pressure Roller

Figure 5:
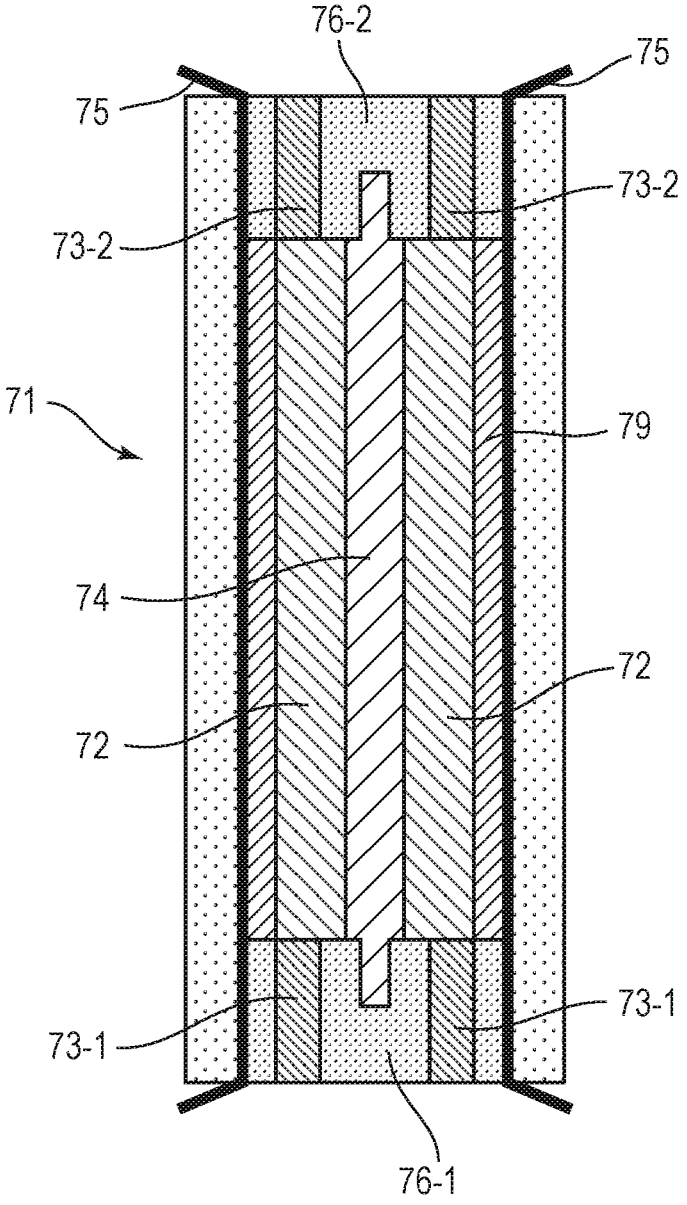
FIG. 5 is a schematic sectional view of the forming mold for the pressure roller.

Next, the production method for the pressure roller 20 in the embodiment will be described. Here, an outline of the production method for the pressure roller 20 will be described with an example of the case of later-described Experiment Example A1. Details of setting of materials, blending quantities, dimensions of each part in each experiment example will be described later. FIG. 4 and FIG. 5 are a schematic external perspective view of a casting mold to be used for the production of the pressure roller 20 in the embodiment and a schematic sectional view taken along the longitudinal direction.

In the present invention, the production method for the pressure roller 20 is not limited to a production method described below. Further, in each experiment example described later, a plurality of pressure rollers 20 was made and provided for evaluations.

<Step of Preparing Liquid Composition for Outer Elastic Layer (First Step)>

A liquid (fluid) composition for the outer elastic layer is prepared by blending the silane coupling agent (methacryloxypropyl trimethoxy silane) in the liquid silicone rubber, further blending the resin microballoon, and sufficiently performing stirring.

<Step of Forming Outer Elastic Layer (Second Step)>

As shown in FIG. 4, by a known method, a fluorine resin tube 75 is tightly fixed in the interior of a metallic cylindrical outer die 71 in which the length in the longitudinal direction is 250 mm, the outer diameter is 28 mm and the inner diameter is 20 mm. The above dimensions are dimensions of portions corresponding to the body portion of the core bar 21, the inner elastic layer 22, the outer elastic layer 23 and the surface release layer 24 in the pressure roller 20. Next, using a ring coating method, the liquid composition for the outer elastic layer prepared in the above first step is applied to the inner side of the fluorine resin tube 75, such that the thickness of an outer elastic layer 79 (FIG. 5) is a predetermined thickness (about 300 μm in Experiment Example A1). In the case where the thickness of the outer elastic layer 79 (FIG. 5) is set to 200 μm or smaller, the position of the outer die 71 and the position of a nozzle (not illustrated) for ring coating are precisely adjusted in a concentric manner. The whole of the outer die 71 to which the fluorine resin tube 75 is fixed is heated at 130° C., and a formed body (FIG. 5) in which the fluorine resin tube 75 fixed to the outer die 71 and the outer elastic layer 79 are integrated is obtained. The above fluorine resin tube 75 becomes the surface release layer 24 of the pressure roller 20, and the above outer elastic layer 79 becomes the outer elastic layer 23 of the pressure roller 20.

<Step of Preparing Liquid Composition for Inner Elastic Layer (Third Step)>

The needle-shaped filler and the resin microballoon are weighted and are blended in a non-cross-linkage addition curing type liquid silicone rubber. Then, mixing is performed using a known mixing stirrer unit such as a planet type universal mixing stirrer. Subsequently, tetraethylene glycol is added as the flocculant for the resin microballoon, and mixing is continued for a certain time, so that a liquid composition for the inner elastic layer is prepared.

<Step of Forming Inner Elastic Layer (Fourth Step)>

As shown in FIG. 5, a cavity 72 of the casting mold is formed by the formed body obtained in a state of being fixed to the outer die 71 in the above second step and a core bar 74 having a surface subjected to a plasma treatment and having a diameter of 15 mm. The core bar 74 is supported in the outer die 71, by bearings 76-1, 76-2. The cavity 72 is formed between the outer circumferential surface of the core bar 74 and the inner circumferential surface of the outer elastic layer 79 formed in the above second step. The cavity 72 communicates with the exterior of the outer die 71 through communication passages 73-1, 73-2. Then, the liquid composition for the inner elastic layer prepared in the above third step is poured from the communication passage 73-1 that is a flow passage, so that the cavity 72 is filled with the liquid composition. Next, the cavity 72 filled with the liquid composition for the inner elastic layer is sealed with an unillustrated sealing unit. The above core bar 74 becomes the core bar 21 of the pressure roller 20.

<Step of Cross-Linkage Curing of Silicone Rubber Component (Fifth Step)>

The casting mold in which the cavity 72 is sealed is heated at 130° C. for 60 minutes, so that the silicone rubber component of the inner elastic layer is cured.

<Demolding Step (Sixth Step)>

The casting mold is appropriately cooled by one of water-cooling and air-cooling, and thereafter, the pressure roller 20 in which the core bar 21, the inner elastic layer 22, the outer elastic layer 23 and the surface release layer 24 are integrated is taken out of the casting mold.

<Secondary Cross-Linkage Step (Seventh Step)>

The pressure roller 20 taken out of the casting mold is put in a circulating hot air oven, and is kept at 230° C. for four hours, so that a secondary cross-linkage is performed.

7. Evaluation Method

Next, the evaluation method for the pressure roller 20 will be described.

<Evaluation Method for Dynamic Viscoelastic Property of Inner Elastic Layer>

A breaking test is performed for evaluating the material property of the inner elastic layer 22 of the formed pressure roller 20. The inner elastic layer 22 is cut out, and the frequency dependence of the dynamic viscoelasticity at the time of the compression is measured using a dynamic viscoelasticity measuring apparatus (Rheogel-E4000: UBM Co., Ltd.).

The size of a cut-out sample of the inner elastic layer 22 is 5 mm in length, 5 mm in width and 2 mm in thickness. Further, in a constant static load mode of applying a compressive stress in a thickness direction of the above sample that corresponds to a thickness direction (a roughly radial direction in the embodiment) of the pressure roller 20, a load of 50 g is given. Further, the test is performed at a temperature of 100° C. and a distortion amplitude of 3 μm (sine wave), a complex elastic modulus E*(1 Hz) when the frequency of the stress is 1 Hz is used as an index at the time of the low-speed operation, and a complex elastic modulus E*(50 Hz) when the frequency of the stress is 50 Hz is used as an index at the time of the high-speed operation. Each of the complex elastic modulus E*(1 Hz) and the complex elastic modulus E*(50 Hz) is represented by the value (the unit is [Pa]) of E" (loss elastic modulus) of $E^*=E'+iE''$ (where, E' is storage elastic modulus, and E" is loss elastic modulus), which is obtained from detection results of the amplitude ratio ($\sigma^*/\varepsilon^*$) and phase difference ($\delta$) between the stress and the distortion at each frequency by the dynamic viscoelasticity measuring apparatus.

<Evaluation Method for Thermal Conductivity of Pressure Roller>

The thermal conductivity $\lambda$ of the pressure roller 20 is measured using a surface thermal conductivity meter (trade name: QTM-500 manufactured by Kyoto Electronics Manufacturing Co., Ltd.), while a sensor probe (type: PD-11 manufactured by Kyoto Electronics Manufacturing Co., Ltd.) of the surface thermal conductivity meter contacts with the surface of the pressure roller 20 roughly parallel to the longitudinal direction of the pressure roller 20. In the measurement, the sensor probe is used after the calibration with a cylindrical body having the same diameter as the pressure roller 20 and made of quartz.

In the measurement of the thermal conductivity $\lambda 2$ of the inner elastic layer 22 and thermal conductivity $\lambda 1$ of the outer elastic layer 23, the surface thermal conductivity meter (trade name: QTM-500 manufactured by Kyoto Electronics Manufacturing Co., Ltd.) is used, similarly to the measurement of the thermal conductivity $\lambda$ of the pressure roller 20. Each of the inner elastic layer 22 and the outer elastic layer 23 is laminated so as to have a thickness enabling the measurement with the surface thermal conductivity meter, and thereby, a measurement sample is made.

<Evaluation Method for Non-Passing Portion Temperature Rise of Pressure Roller>

The pressure roller 20 in each example is built in the fixing apparatus 6 in the embodiment shown in FIG. 2A, and the fixing apparatus 6 is equipped in the image forming apparatus 100 in the embodiment shown in FIG. 1. Then, 50 recording materials (paper sheet) P on each of which a predetermined image pattern is formed is continuously conveyed (passed) to the fixing nip N under a predetermined condition described below, and the temperature (more specifically, the surface temperature of the pressure roller 20) of the non-passing portion of the pressure roller 20 is measured. The above predetermined condition is a condition that the processing velocity (corresponding to the conveying velocity of the recording material P at the fixing nip N) is 270 mm/sec, the environment is an environment of an atmospheric temperature of 25° C. and a humidity of 50%, and the target temperature (controlled temperature) in temperature control of the heater 11 of the fixing apparatus 6 is 200° C. As the paper sheet, CANON Red Label (80 g/cm$^2$) is used after the cutting into the B5 size.

It is rare for the pressure roller 20 to be broken just by the continuous passing of 50 paper sheets. Here, the non-passing portion temperature rise is evaluated based on whether the temperature of the non-passing portion of the pressure roller 20 increases to 230° C., at which the pressure roller 20 is easily broken due to the oxidation degradation of the silicone rubber.

8. Configuration of Experiment Examples

Next, the present invention will be further specifically described with experiment examples.

Experiment Example A1

The pressure roller 20 in Experiment Example A1 was produced as follows.

Step of Preparing Liquid Composition for Outer Elastic Layer (First Step)

The liquid composition for the outer elastic layer was prepared by blending 1 pts.wt. of the silane coupling agent (methacryloxypropyl trimethoxy silane) in 100 pts.wt. of the liquid silicone rubber, further blending 5 pts.wt. of the resin microballoon (trade name: F80-DE manufactured by Matsumoto Yushi-Seiyaku Co., Ltd.) having an average particle diameter of 100 μm, and sufficiently performing stirring.

Step of Forming Outer Elastic Layer (Second Step)

In the way described above with reference to FIG. 4 and FIG. 5, the formed body in which the fluorine resin tube 75 fixed to the outer die 71 and the outer elastic layer 79 were integrated was obtained. On this occasion, the liquid composition for the outer elastic layer prepared in the above first step was applied to the inner side of the fluorine resin tube 75, and the whole of the outer die 71 was heated at 130° C. Further, the thickness of the outer elastic layer 23 formed by ring coating was about 300 μm.

Step of Preparing Liquid Composition for Inner Elastic Layer (Third Step)

In 100 pts.wt. of the non-cross-linkage addition curing type liquid silicone rubber, 15 pts.wt. of the needle-shaped filler (trade name: GRANOC Milled Fiber XN-100-25M manufactured by Nippon Graphite Fiber Corporation) and 5 pts.wt. of the resin microballoon (trade name: F80-DE manufactured by Matsumoto Yushi-Seiyaku Co., Ltd.) were weighted and were blended. Then, using a universal mixing stirrer (trade name: T.K HIVIS MIX 2P-1 manufactured by PRIMIX Corporation), stirring was performed while the rotation number of an impeller was 80 rpm. Subsequently, 5 pts.wt. of tetraethylene glycol was added as the flocculant for the resin microballoon, and stirring was further performed, so that the liquid composition for the inner elastic layer was prepared.

Step of Forming Inner Elastic Layer (Fourth Step)

The core bar 74 having a surface subjected to a primer (trade name: DY39-051 manufactured by Dow Corning Toray Co., Ltd.) treatment and having the body portion with an outer diameter of 15 mm was prepared. Further, in the way described above with reference to FIG. 5, the casting mold having the cavity 72 was formed by assembling the core bar 74, the outer die 71 in which the formed body obtained in the above second step was fixed, and the bearings 76-1, 76-2. Then, the liquid composition for the inner elastic layer prepared in the above third step was poured at a velocity of 50 $cm^3$/minute, the cavity 72 was filled with the liquid composition, and flow-out was confirmed. Next, the cavity 72 was sealed with an unillustrated sealing unit.

Step of Cross-Linkage Curing of Silicone Rubber Component (Fifth Step), Demolding Step (Sixth Step) and Secondary Cross-Linkage Step (Seventh Step)

The casting mold in which the cavity 72 was sealed was heated at 130° C. for one hour, in a hot air oven, so that the silicone rubber was cured (fifth step). After the cooling of the casting mold, the pressure roller was taken out of the casting mold (sixth step). Next, the pressure roller was heated at 230° C. for four hours, in the hot air oven (seventh step). Finally, the secondary process of cutting excess end portions was performed, so that the pressure roller 20 in Experiment Example A1 was obtained.

Experiment Example A2

The pressure roller 20 in Experiment Example A2 was obtained by the same production method as Experiment Example A1, except that the quantity of the resin microballoon to be blended in the liquid silicone rubber was 2 pts.wt. in the third step.

Experiment Example A3

The pressure roller 20 in Experiment Example A3 was obtained by the same production method as Experiment Example A1, except that the resin microballoon was not blended and the blending quantities of the needle-shaped filler and the flocculant were the same as the blending quantities in Experiment Example A1 in the third step.

Experiment Example A4

The pressure roller 20 in Experiment Example A4 was obtained by the same production method as Experiment Example A1, except that the resin microballoon and the flocculant were not blended and the blending quantity of the needle-shaped filler was the same as the blending quantity in Experiment Example A1 in the third step.

Experiment Example B2

The pressure roller 20 in Experiment Example B2 was obtained by the same production method as Experiment Example A1, except that the quantity of the needle-shaped filler to be blended in the liquid silicone rubber was 25 pts.wt. in the third step.

Experiment Example B3

The pressure roller 20 in Experiment Example B3 was obtained by the same production method as Experiment Example A1, except that the quantity of the needle-shaped filler to be blended in the liquid silicone rubber was 10 pts.wt. in the third step.

Experiment Example B4

The pressure roller 20 in Experiment Example B4 was obtained by the same production method as Experiment Example A1, except that the quantity of the needle-shaped filler to be blended in the liquid silicone rubber was 5 pts.wt. in the third step.

Experiment Example C2

The pressure roller 20 in Experiment Example C2 was obtained by the same production method as Experiment Example A1, except that the thickness of the outer elastic layer 23 to be formed by ring coating was 150 μm in the second step and the thickness of the inner elastic layer 22 was 2350 μm in the fourth step.

Experiment Example C3

The pressure roller 20 in Experiment Example C3 was obtained by the same production method as Experiment Example A1, except that the thickness of the outer elastic layer 23 to be formed by ring coating was 500 μm in the second step and the thickness of the inner elastic layer 22 was 2000 μm in the fourth step.

Experiment Example C4

The pressure roller 20 in Experiment Example C4 was obtained by the same production method as Experiment Example A1, except that the thickness of the outer elastic layer 23 to be formed by ring coating was 300 μm in the second step and the thickness of the inner elastic layer 22 was 3200 μm in the fourth step while the core bar 74 having the body portion with an outer diameter of 13 mm was used.

9. Evaluation Experiments

Table 1 summarizes the thicknesses of the elastic layers and the blending ratios of the addition curing type liquid silicone rubber, the needle-shaped filler, the resin microballoon and the flocculant, for each experiment example. As described above, for simplification, the table shows the thickness of the inner elastic layer 22 and the total thickness of the inner elastic layer 22 and the outer elastic layer 23, without regard for the thickness of the surface release layer 24. The thickness of the inner elastic layer 22 and the total thickness of the inner elastic layer 22 and the outer elastic layer 23 are, more specifically, thicknesses resulting from subtracting the thickness of the surface release layer 24 from the displayed values.

TABLE 1

| | Thickness of Elastic Layer (unit: μm) | | | Ratio of Inner Elastic Layer (unit: pts.wt.) | | | |
|---|---|---|---|---|---|---|---|
| | Outer Layer | Inner Layer | Total | Silicone Rubber | Needle-shaped Filler | Resin Microballoon | Tetraethylene Glycol |
| Experiment Example A1 | 300 | 2200 | 2500 | 100 | 15 | 5 | 5 |
| Experiment Example A2 | 300 | 2200 | 2500 | 100 | 15 | 2 | 5 |
| Experiment Example A3 | 300 | 2200 | 2500 | 100 | 15 | 0 | 5 |
| Experiment Example A4 | 300 | 2200 | 2500 | 100 | 15 | 0 | 0 |
| Experiment Example B2 | 300 | 2200 | 2500 | 100 | 25 | 5 | 5 |
| Experiment Example B3 | 300 | 2200 | 2500 | 100 | 10 | 1 | 5 |
| Experiment Example B4 | 300 | 2200 | 2500 | 100 | 5 | 5 | 5 |
| Experiment Example C2 | 150 | 2350 | 2500 | 100 | 15 | 5 | 5 |
| Experiment Example C3 | 500 | 2000 | 2500 | 100 | 15 | 5 | 5 |
| Experiment Example C4 | 300 | 3200 | 3500 | 100 | 15 | 5 | 5 |

In the above-described experiment examples, evaluation experiments for the dynamic viscoelastic property of the inner elastic layer 22, the thermal conductivity of the pressure roller 20 and the non-passing portion temperature rise of the pressure roller 20 were performed. Table 2 shows evaluation results. The evaluation methods for the dynamic viscoelastic property of the inner elastic layer 22, the thermal conductivity of the pressure roller 20 and the non-passing portion temperature rise of the pressure roller 20 have been described above.

TABLE 2

| | Evaluation of Elastic Layer (dynamic viscoelastic property measurement) | | | Evaluation of Pressure Roller | |
|---|---|---|---|---|---|
| | E*(1 Hz) [Pa] | E*(50 Hz) [Pa] | E*(50 Hz)/E*(1 Hz) | Thermal Conductivity [W/m · K] | Non-passing Portion Temperature [° C.] |
| Experiment Example A1 | $4.2 \times 10^5$ | $4.4 \times 10^5$ | 1.05 | 1.36 | 212 |
| Experiment Example A2 | $3.5 \times 10^5$ | $4.1 \times 10^5$ | 1.17 | 1.02 | 222 |
| Experiment Example A3 | $3.1 \times 10^5$ | $4.4 \times 10^5$ | 1.41 | Evaluation was avoided because of depressions on surface. | |
| Experiment Example A4 | $3.1 \times 10^5$ | $4.7 \times 10^5$ | 1.52 | 0.88 | 225 |
| Experiment Example B2 | $3.8 \times 10^5$ | $4.2 \times 10^5$ | 1.11 | 3.00 | 195 |
| Experiment Example B3 | $3.6 \times 10^5$ | $4.7 \times 10^5$ | 1.30 | 0.82 | 226 |
| Experiment Example B4 | $3.2 \times 10^5$ | $3.5 \times 10^5$ | 1.09 | 0.45 | 250 |
| Experiment Example C2 | $4.0 \times 10^5$ | $4.0 \times 10^5$ | 1.01 | 1.85 | 209 |
| Experiment Example C3 | $4.1 \times 10^5$ | $4.4 \times 10^5$ | 1.08 | 0.50 | 230 |
| Experiment Example C4 | $4.3 \times 10^5$ | $4.5 \times 10^5$ | 1.05 | 0.25 | 265 |

(1) Experiment Examples A1 to A4

In Experiment Example A1, E*(50 Hz)/E*(1 Hz) was 1.05, and the frequency dependence of the dynamic viscoelasticity of the inner elastic layer 22 was low. In Experiment Example A1, the thermal conductivity of the pressure roller 20 was 1.36 [W/m·K]. In the fixing apparatus 6 equipped with the pressure roller 20, the temperature of the non-passing portion of the pressure roller 20 after the 50-sheet continuous passing in the case where the controlled temperature was set to 200° C. was 212° C. Experiment Example A1 is OK, from the standpoint of the securement of the softness of the elastic layer and the performance of the suppression of the non-passing portion temperature rise.

In Experiment Example A2, E*(50 Hz)/E*(1 Hz) was 1.17, and the frequency dependence of the dynamic viscoelasticity of the inner elastic layer 22 was higher than that in Experiment Example A1, but was sufficiently low, similarly. In Experiment Example A2, the thermal conductivity of the pressure roller 20 was 1.02 [W/m·K], and was lower than that in Experiment Example A1. The reason is thought to be that the needle-shaped filler was oriented in the longitudinal direction at the time of the casting because the blending quantity of the resin microballoon blended in the inner elastic layer 22 was smaller than that in Experiment Example A1. In the fixing apparatus 6 equipped with the pressure roller 20, the temperature of the non-passing portion of the pressure roller 20 after the 50-sheet continuous passing in the case where the controlled temperature was set to 200° C. was 222° C. Experiment Example A2 is OK, from the standpoint of the securement of the softness of the elastic layer and the performance of the suppression of the non-passing portion temperature rise.

In Experiment Example A3, the liquid silicone rubber and the flocculant were not mutually solved at the time of the preparation of the liquid composition for the inner elastic layer. When the forming was performed in that state, a plurality of depressions was recognized on some portions of the surface of the pressure roller 20 after the forming. It was thought that the unsolved flocculant caused the depressions. Therefore, the pressure roller 20 was not built in the fixing apparatus 6, and the evaluations of the thermal conductivity and the non-passing portion temperature rise were not performed. In Experiment Example A3, E*(50 Hz)/E*(1 Hz) was 1.41, and the frequency dependence of the dynamic viscoelasticity of the inner elastic layer 22 was high. Experiment Example A3 is NG, from the standpoint of the securement of the softness of the elastic layer and the performance of the suppression of the non-passing portion temperature rise.

In Experiment Example A4, E*(50 Hz)/E*(1 Hz) was 1.52, and the frequency dependence of the dynamic viscoelasticity of the inner elastic layer 22 was high. In Experiment Example A4, the thermally conductivity of the pressure roller 20 was 0.88 [W/m·K]. In the fixing apparatus 6 equipped with the pressure roller 20, it was necessary to set the controlled temperature to a higher temperature than the controlled temperature in Experiment Example A1, for obtaining an image quality equivalent to the image quality in Experiment Example A1. That is, it was thought that the fixing nip N in Experiment Example A4 was narrower than the fixing nip N in Experiment Example A1, and it was suggested that the deformation of the pressure roller 20 was insufficient. In the fixing apparatus 6 equipped with the pressure roller 20, the temperature of the non-passing portion of the pressure roller 20 after the 50-sheet continuous passing in the case where the controlled temperature was set to 200° C. was 225° C. Experiment Example A4 is NG, from the standpoint of the securement of the softness of the elastic layer and the performance of the suppression of the non-passing portion temperature rise.

As the above image quality, as an example, the fixation quality of a test image formed on the recording material P was evaluated. For the fixation quality, a predetermined test image is formed on the recording material P, and the reflection densities before and after the test image is scratched under a predetermined condition are measured. Then, the fixation quality can be evaluated based on the rate (fixation ratio) of the reflection density after the scratching/the reflection density before the scratching.

(2) Experiment Examples B2 to B4

In Experiment Example B2, it was necessary to add the needle-shaped filler in a plurality of parts, in the preparation of the liquid composition for the inner elastic layer. In Experiment Example B2, E*(50 Hz)/E*(1 Hz) was 1.11, and the frequency dependence of the dynamic viscoelasticity of the inner elastic layer 22 was low. In Experiment Example B2, the thermal conductivity of the pressure roller 20 was 3.00 [W/m·K]. In the fixing apparatus 6 equipped with the pressure roller 20, the temperature of the non-passing portion of the pressure roller 20 after the 50-sheet continuous passing in the case where the controlled temperature was set to 200° C. was 195° C. From the experiment example, when the blending quantity of the needle-shaped filler is large, the preparation of the liquid composition is complicated, or the forming becomes difficult, in some cases. That is, it is found that the thermal conductivity of the pressure roller 20 only needs to be 3.0 [W/m·K] or lower. Experiment Example B2 is OK, from the standpoint of the securement of the softness of the elastic layer and the performance of the suppression of the non-passing portion temperature rise.

In Experiment Example B3, E*(50 Hz)/E*(1 Hz) was 1.30, and the frequency dependence of the dynamic viscoelasticity of the inner elastic layer 22 was higher than that in Experiment Example A1, but was sufficiently low, similarly. In Experiment Example B3, the thermal conductivity of the pressure roller 20 was 0.82 [W/m·K]. In the fixing apparatus 6 equipped with the pressure roller 20, the temperature of the non-passing portion of the pressure roller 20 after the 50-sheet continuous passing in the case where the controlled temperature was set to 200° C. was 226° C. Experiment Example B3 is OK, from the standpoint of the securement of the softness of the elastic layer and the performance of the suppression of the non-passing portion temperature rise.

In Experiment Example B4, E*(50 Hz)/E*(1 Hz) was 1.09, and the frequency dependence of the dynamic viscoelasticity of the inner elastic layer 22 was low. However, in Experiment Example B4, the thermal conductivity of the pressure roller 20 was 0.45 [W/m·K]. Further, in the fixing apparatus 6 equipped with the pressure roller 20, the temperature of the non-passing portion of the pressure roller 20 after the 50-sheet continuous passing in the case where the controlled temperature was set to 200° C. was 250° C., and exceeded 230° C., which was the index for the non-passing portion temperature rise. That is, it is found that the blending quantity of the needle-shaped filler can be more than that in the experiment example and the thermal conductivity of the pressure roller 20 can be higher than 0.5 [W/m·K] for sufficiently suppressing the non-passing portion temperature rise. Experiment Example B4 is NG, from the standpoint of the securement of the softness of the elastic layer and the performance of the suppression of the non-passing portion temperature rise.

(3) Experiment Examples C2 to C4

In Experiment Example C2, in the forming of the outer elastic layer 23, the position of the outer die and the position of the nozzle for ring coating were precisely adjusted in a concentric manner. In Experiment Example C2, E*(50 Hz)/E*(1 Hz) was 1.01, and the frequency dependence of the dynamic viscoelasticity of the inner elastic layer 22 was low. In Experiment Example C2, the thermal conductivity of the pressure roller 20 was 1.85 [W/m·K]. It is thought that the thermal conductivity of the pressure roller 20 was higher than that in Experiment Example A1 because the thickness of the outer elastic layer 23 was smaller than that in Experiment Example A1. In the fixing apparatus 6 equipped with the pressure roller 20, the temperature of the non-passing portion of the pressure roller 20 after the 50-sheet continuous passing in the case where the controlled temperature was set to 200° C. was 209° C. That is, it is found that the thickness of the outer elastic layer 23 can be equal to or larger than 150 μm in the experiment example, for exerting a sufficient quick start property. Experiment Example C2 is OK, from the standpoint of the securement of the softness of the elastic layer and the performance of the suppression of the non-passing portion temperature rise.

In Experiment Example C3, E*(50 Hz)/E*(1 Hz) was 1.08, and the frequency dependence of the dynamic viscoelasticity of the inner elastic layer 22 was low. However, in Experiment Example C3, the thermal conductivity of the pressure roller 20 was 0.50 [W/m·K]. It is thought that the thermal conductivity of the pressure roller 20 was lower than that in Experiment Example A1 because the thickness of the outer elastic layer 23 was larger than that in Experiment Example A1. Further, in the fixing apparatus 6 equipped with the pressure roller 20, the temperature of the non-passing portion of the pressure roller 20 after the 50-sheet continuous passing in the case where the controlled temperature was set to 200° C. was 230° C., and got to be 230° C., which was the index for the non-passing portion temperature rise. That is, it is found that the thickness of the outer elastic layer 23 can be smaller than 500 μm in the experiment example and the thermal conductivity of the pressure roller 20 can be higher than 0.5 [W/m·K], for sufficiently suppressing the non-passing portion temperature rise. Experiment Example C3 is NG, from the standpoint of the securement of the softness of the elastic layer and the performance of the suppression of the non-passing portion temperature rise.

In Experiment Example C4, E*(50 Hz)/E*(1 Hz) was 1.05, and the frequency dependence of the dynamic viscoelasticity of the inner elastic layer 22 was low. However, in Experiment Example C4, the thermal conductivity of the pressure roller 20 was 0.25 [W/m·K]. It is thought that the thermal conductivity of the pressure roller 20 was lower than that in Experiment Example A1 because the thickness of the inner elastic layer 22 was larger than that in Experiment Example A1 and the performance of the heat release to the core bar 21 was low. Further, in the fixing apparatus 6 equipped with the pressure roller 20, the temperature of the non-passing portion of the pressure roller 20 after the 50-sheet continuous passing in the case where the controlled temperature was set to 200° C. was 265° C., and exceeded 230° C., which was the index for the non-passing portion temperature rise. The thickness of the inner elastic layer 22 can be 2 mm or larger and 3 mm or smaller (2000 μm or larger and 3000 μm or smaller). Experiment Example C4 is NG, from the standpoint of the securement of the softness of the elastic layer and the performance of the suppression of the non-passing portion temperature rise.

In the case where the inner elastic layer 22 has no communication hole and has substantially only the independent hole, the formation of the fixing nip N sometimes becomes unstable by the change in the outer diameter of the pressure roller 20 due to the expansion and contraction of the air existing in the interior of the void portion 22*b* at the time of the heating and the time of the cooling. Further, in the case where the thermal conductive filler has no needle shape (or fiber shape) in a configuration in which the void portion 22*b* and the hole pathway portion 22*c* are provided in the inner elastic layer 22, the formation of the thermal conductive path in the thickness direction of the inner elastic layer 22 sometimes becomes insufficient, so that the non-passing portion temperature rise cannot be sufficiently suppressed.

As described above, the pressure roller 20 in the embodiment can exert the softness even at the time of the high-speed operation, similarly to the low-speed operation. Thereby, the fixing apparatus 6 in the embodiment can stably secure the fixing nip N both at the time of the low-speed operation and at the time of the high-speed operation, and can achieve both the quick start property and the suppression of the non-passing portion temperature rise. Consequently, the image forming apparatus 100 in the embodiment can provide a stable-quality image both at the time of the low-speed operation and at the time of the high-speed operation. That is, according to the embodiment, the nip portion can be stably formed, and both the quick start property and the suppression of the non-passing portion temperature rise can be achieved.

Other Embodiments

The present invention has been described above, with the specific embodiment. However, the present invention is not limited to the above-described embodiment.

In the above-described embodiment, the heating member includes an endless film (or belt) as the heating rotation body, but the present invention is not limited to the endless film (or belt). The heating member may include a roller-shaped member (fixing roller) as the heating rotation body. In the above-described embodiment, the heating rotation body of the heating member is heated by the heater provided on the inner side (inner circumferential surface side), but the present invention is not limited to the heating by the heater. The heating rotation body that is an endless belt or the like may perform self-heating by energization. Further, the heating rotation body that is an endless belt or the like may be electromagnetically heated by an exciting coil provided on the outer side (outer circumferential surface side).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-159770, filed Aug. 28, 2018, and, Japanese Patent Application No. 2019-135738, filed Jul. 23, 2019, which are hereby incorporated by reference herein in their entirety.

What is claimed is:

1. A pressure roller to be used in a fixing apparatus, the fixing apparatus configured to heat a toner image formed on a recording material and fix the toner image on the recording material, the pressure roller comprising:

a first elastic layer; and a second elastic layer provided on an outside of the first elastic layer, wherein a thermal conductivity of the first elastic layer is higher than a thermal conductivity of the second elastic layer, wherein the first elastic layer contains a plurality of void portions, hole pathway portions joining the plurality of void portions to each other, and a needle-shaped high thermal conductive filler, and wherein in a case of measuring a dynamic viscoelastic property of a sample of the first elastic layer by applying a compressive stress at a temperature of 100° C. and an amplitude of 3 μm in a thickness direction of the pressure roller, a rate E*(50 Hz)/E*(1 Hz) between a complex elastic modulus E*(1 Hz) when a frequency of the compressive stress is 1 Hz and a complex elastic modules E*(50 Hz) when the frequency of the compressive stress is 50 Hz satisfies a following expression:

$$1.0 \leq E^*(50\ \text{Hz})/E^*(1\ \text{Hz}) \leq 1.3.$$

2. The pressure roller according to claim 1, wherein the void portions of the first elastic layer are void portions deriving from resin microballoons.

3. The pressure roller according to claim 2, wherein the first elastic layer is a silicone rubber layer resulting from curing and molding, by heat, a liquid silicone rubber containing the resin microballoons, a flocculant and the high thermal conductive filler.

4. The pressure roller according to claim 3, wherein a blending quantity of the resin microballoons is 0.5 to 8 pts.wt. in 100 pts.wt. of the liquid silicone rubber.

5. The pressure roller according to claim 4, wherein the flocculant is tetraethylene glycol, and wherein a blending quantity of the tetraethylene glycol is 3 to 15 pts.wt. in 100 pts.wt. of the liquid silicone rubber.

6. The pressure roller according to claim 1, wherein the void portions and the hole pathway portions are provided in the first elastic layer at a volume ratio of 35 vol % to 65 vol %.

7. The pressure roller according to claim 1, wherein the high thermal conductive filler is at least one of a pitch-based carbon fiber, a PAN-based carbon fiber, a glass fiber and an inorganic whisker.

8. The pressure roller according to claim 1, wherein a thickness of the second elastic layer is 150 μm to less than 500 μm.

9. The pressure roller according to claim 1, wherein the second elastic layer contains a plurality of void portions.

10. The pressure roller according to claim 9, wherein the void portions of the second elastic layer are void portions deriving from resin microballoons.

11. The pressure roller according to claim 1, wherein a thickness of the first elastic layer is 2 mm to 3 mm.

12. The pressure roller according to claim 1, further comprising a fluorine resin layer, wherein a thickness of the fluorine resin layer is 10 μm to 100 μm.

13. A fixing apparatus configured to heat a toner image formed on a recording material at a fixing nip portion while nipping and conveying the recording material and to fix the toner image on the recording material, the fixing apparatus comprising:

a heating unit; and the pressure roller according to claim 1, the pressure roller configured to form the fixing nip portion with the heating unit.

14. The fixing apparatus according to claim 13, wherein the heating unit includes a heater.

15. The fixing apparatus according to claim 13, wherein the heating unit comprises a cylindrical fixing film and a heater in contact with an inner surface of the fixing film.

16. The fixing apparatus according to claim 15, wherein the fixing nip portion is formed by applying pressure between the heater and the pressure roller through the fixing film.

17. An image forming apparatus configured to form a tonner image on a recording material, the image forming apparatus comprising:

an image forming unit configured to form the tonner image on the recording material; and the fixing apparatus according to claim 13, the fixing apparatus configured to fix the tonner image formed on the recording material, on the recording material.

18. The pressure roller according to claim 1, wherein a thermal conductivity λ of the pressure roller satisfies a following expression:

$$0.5\ [\text{W/m·K}] < \lambda \leq 3.0\ [\text{W/m·K}].$$

19. The pressure roller according to claim 18, wherein the thermal conductivity of the first elastic layer is 0.2 [W/m·K] to 1.0 [W/m·K], and the thermal conductivity of the second elastic layer is 0.05 [W/m·K] to 0.2 [W/m·K].

* * * * *